US005657968A

United States Patent [19]

Marsden

[11] Patent Number: 5,657,968

[45] Date of Patent: Aug. 19, 1997

[54] ADJUSTABLE STAIR RAILING

[76] Inventor: Jeff Marsden, 871 Spring Creek Way, Templeton, Calif. 93465

[21] Appl. No.: 582,552

[22] Filed: Jan. 2, 1996

[51] Int. Cl.[6] ..... E04F 11/18

[52] U.S. Cl. ..... 256/65; 256/68; 256/59; 256/67

[58] Field of Search ..... 256/68, 67, 65, 256/59; 403/298

[56] References Cited

U.S. PATENT DOCUMENTS

| | | | |
|---|---|---|---|
| 1,785,487 | 12/1930 | McAvoy | 256/72 X |
| 3,005,242 | 10/1961 | Roberts | 256/59 X |
| 3,157,378 | 11/1964 | Blum | 256/59 X |
| 3,883,257 | 5/1975 | Delafield | 403/298 X |
| 4,556,201 | 12/1985 | Turner | 256/59 X |
| 5,337,528 | 8/1994 | Jaworski et al. | 256/59 X |

FOREIGN PATENT DOCUMENTS

| | | | |
|---|---|---|---|
| 6-240887 | 8/1994 | Japan | 256/59 |

*Primary Examiner*—Anthony Knight
*Attorney, Agent, or Firm*—Michael I. Kroll

[57] ABSTRACT

An adjustable stair railing (12) for a stairway railing (14) being a plurality of balusters (16) supporting a handrail (18) on a stairway (20). The adjustable stair railing (12) comprises an auxiliary rail (22) and a facility (24) for attaching the auxiliary rail (22) to some of the balusters (16) in a height adjustable manner and a parallel relationship below the handrail (18) on the stairway railing (14). A young child unable to reach the handrail (18) can now grip the auxiliary rail (22), to travel up and down the stairway (20) in safety without tripping on the stairway (20).

20 Claims, 4 Drawing Sheets

3
38
46
12
28
26
14
24
36
32
16
18
5
22
2
34
20
30
26
12
30
34
4
38
36
22
24
28
32
46

18
14
12
22
34
26
30
16
38
9
52
36
24
54
28
32
48
50

30
38
12
36
28
24
52
54
48
32
58
50
56

38
30
12
24
28
36
52
50
48
50
58
10
56
52
32

50
58
52
12
56
48
32

ADJUSTABLE STAIR RAILING

BACKGROUND OF THE INVENTION

1. Field of the Invention

The instant invention relates generally to stairway railings and more specifically it relates to an adjustable stair railing.

2. Description of the Prior Art

Numerous stairway railings have been provided in prior art that are adapted to be mounted on flights of stairs to allow people to hold onto the railings, when traveling up and down the stairs. While these units may be suitable for the particular purpose to which they address, they would not be as suitable for the purposes of the present invention as heretofore described.

SUMMARY OF THE INVENTION

A primary object of the present invention is to provide an adjustable stair railing that will overcome the shortcomings of the prior art devices.

Another object is to provide an adjustable stair railing that can be adjusted in height to an existing stairway railing to suit the reach of a young child when the young child is walking up or down on a staircase.

An additional object is to provide an adjustable stair railing that can be removed in a matter of minutes with no trace of it ever being there when the child outgrows the need for it.

A further object is to provide an adjustable stair railing that is simple and easy to use.

A still further object is to provide an adjustable stair railing that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figures 1, 2:
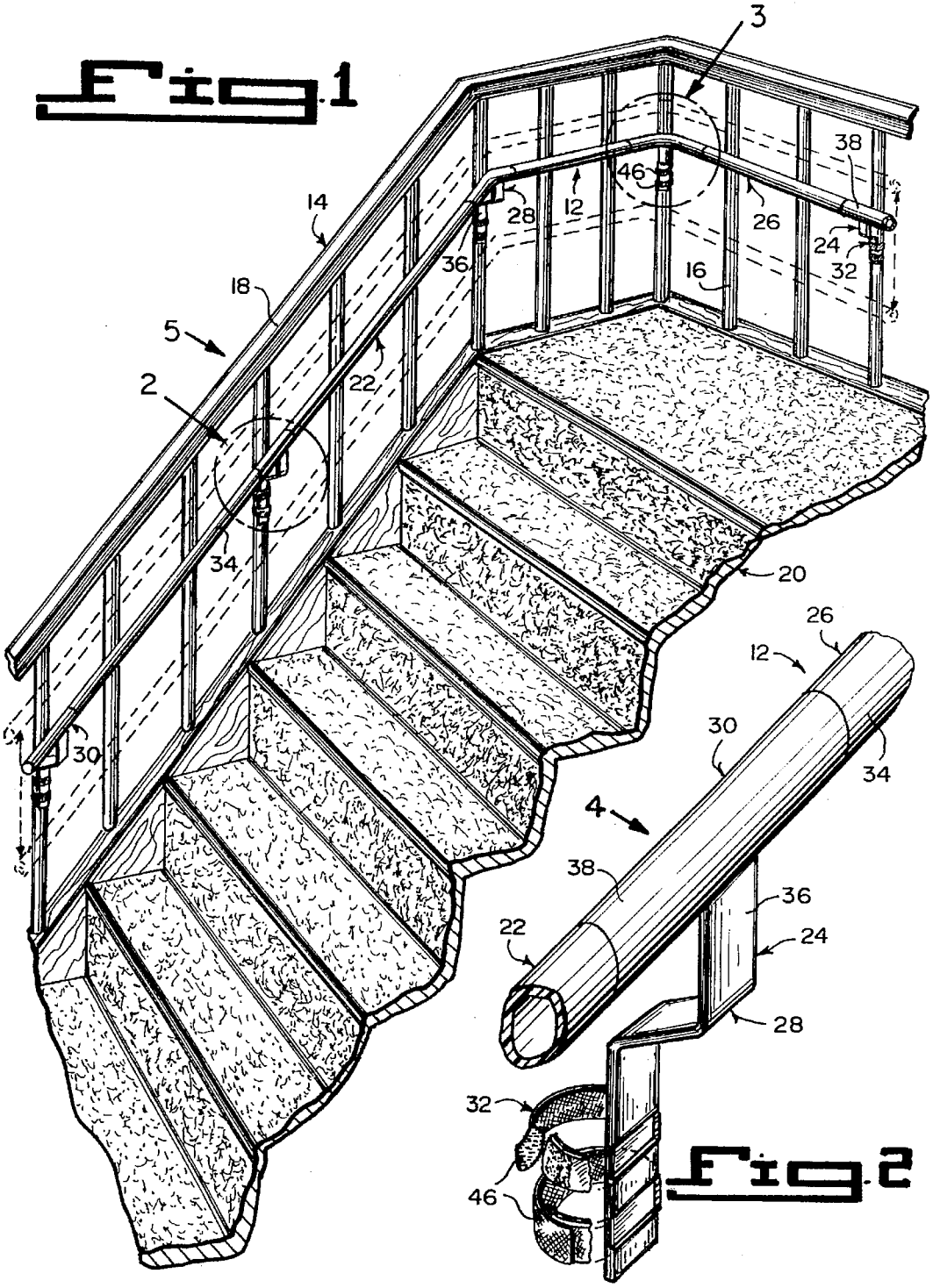
FIG. 1 is a perspective view of a stairway with parts broken away and in section, showing a first embodiment of the instant invention applied to the balusters of the staircase railing.
FIG. 2 is an enlarged perspective view as indicated by arrow 2 in FIG. 1, showing one of the support brackets in greater detail.

Turning now descriptively to the drawings, in which similar reference characters denote similar elements throughout the several views, FIGS. 1 through 10 illustrate an adjustable stair railing 12 for a stairway railing 14, being a plurality of balusters 16 supporting a handrail 18 on a stairway 20. The adjustable stair railing 12 comprises an auxiliary rail 22 and a facility 24, for attaching the auxiliary rail 22 to some of the balusters 16 in a height adjustable manner and a parallel relationship below the handrail 18 on the stairway railing 14. A young child unable to reach the handrail 18 can now grip the auxiliary rail 22, to travel up and down the stairway 20 in safety without tripping on the stairway 20.

The auxiliary rail 22 includes a plurality of elongated members 26 that are interconnected to the attaching facility 24. The attaching facility 24 consists of a plurality of brackets 28. Structures 30 are for connecting the brackets 28 to the auxiliary rail 22. Components 32 are for retaining the brackets 28 in a removable manner to some of the balusters 16 on the stairway railing 14.

Each elongated member 26 is a hollow tubular bar 34. Each bracket 28 is a flat bent up and out arm 36. Each connecting structure 30 consists of a short hollow pipe 38, transversely mounted on a top end of the bracket 28. An element 40 is for holding one end of the auxiliary rail 22 to one end of the short hollow pipe 38.

Figure 3:
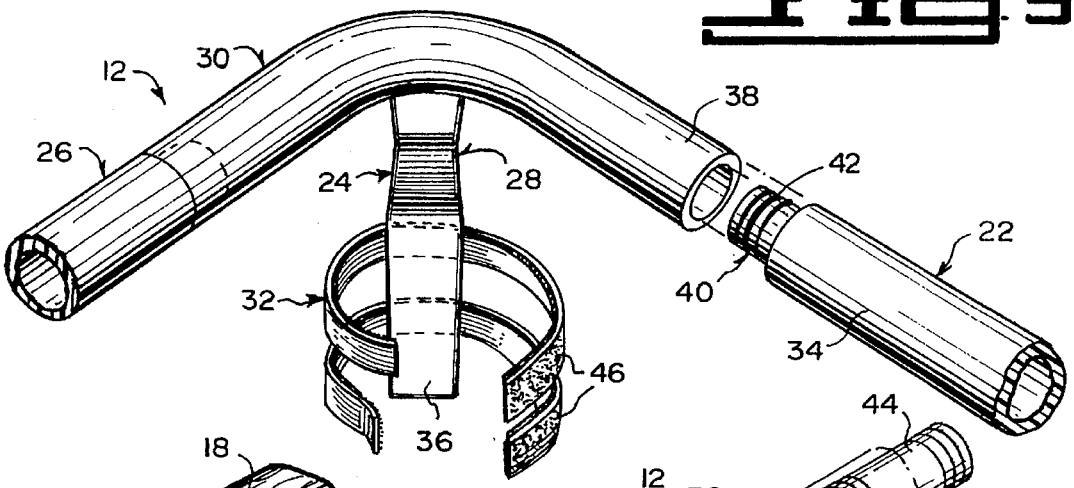
FIG. 3 is an enlarged perspective view as indicated by arrow 3 in FIG. 1, showing the corner bracket in greater detail.
Figure 4:
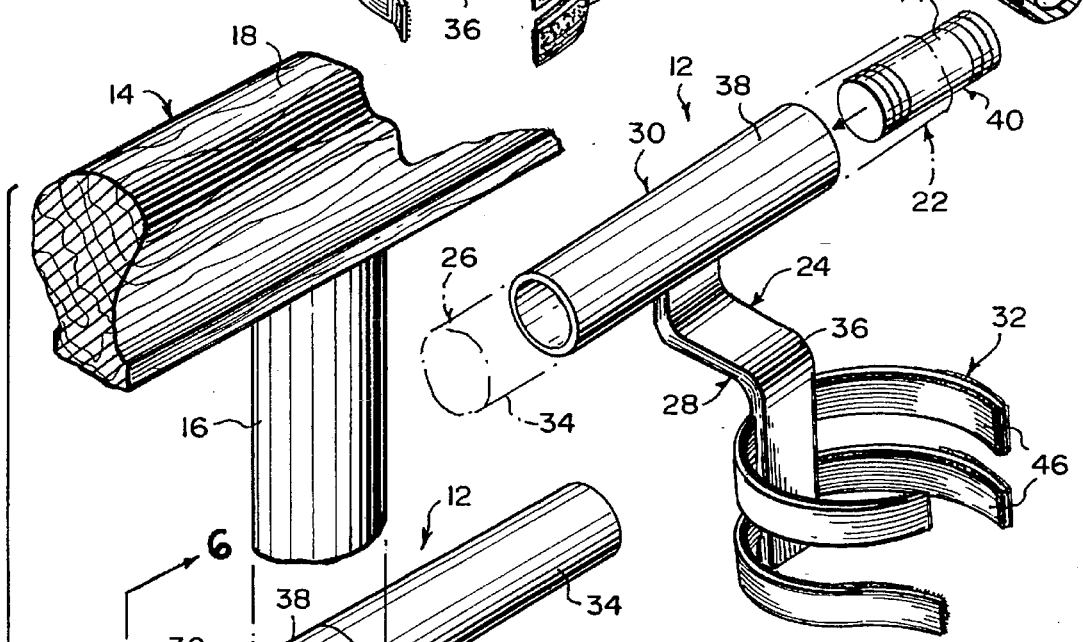
FIG. 4 is a perspective view taken in the direction of arrow in FIG. 2.
Figure 5:
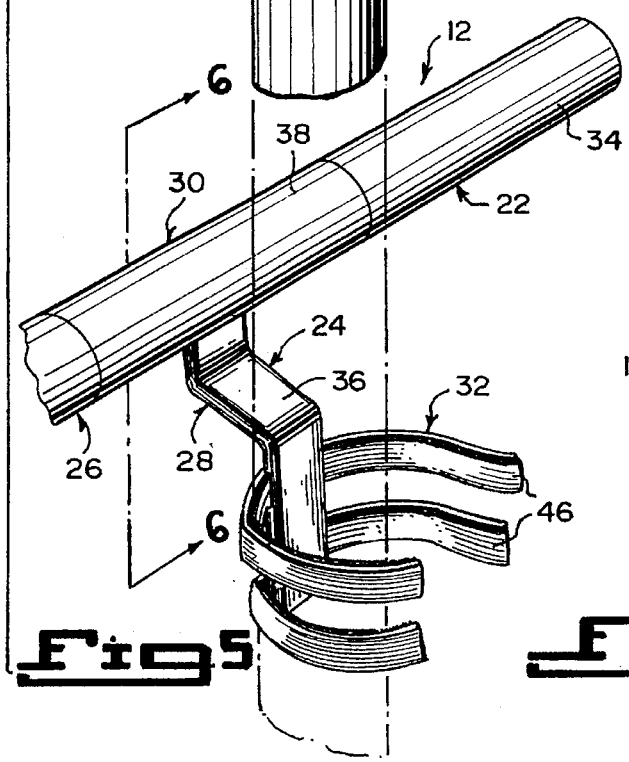
FIG. 5 is an enlarged perspective view taken in the direction of arrow 5 in FIG. 1, with parts broken away, in section and in phantom.
Figure 6:
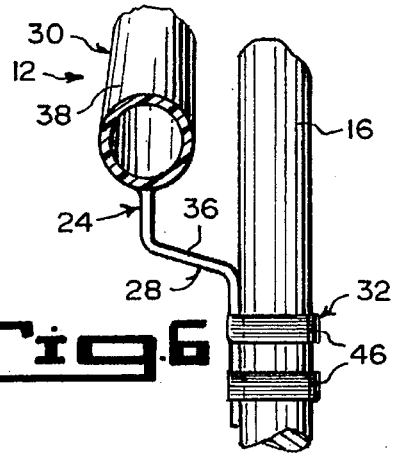
FIG. 6 is a cross sectional view taken along line 6—6 in FIG. 5.
Figure 7:
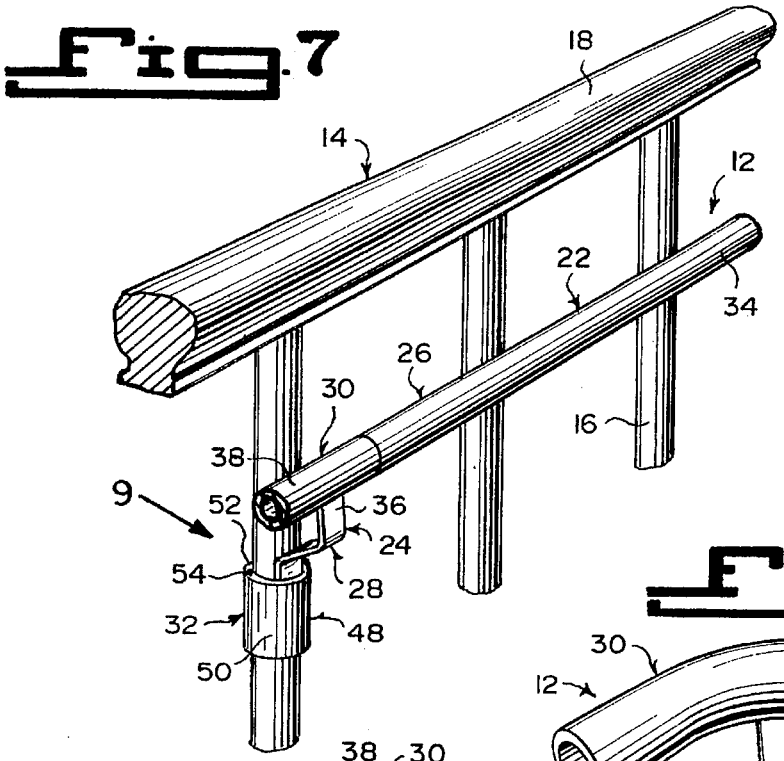
FIG. 7 is a perspective view of a portion of a stairway railing, showing a segment of a second embodiment of the instant invention applied to one baluster.

The holding element 40, as shown in FIG. 3, is a ribbed stud 42 extending from one end of the auxiliary rail 22 that can be inserted into one end of the short hollow pipe 38. The holding element 40, as shown in FIG. 4, can also be a cylindrical plug 44 being ribbed on both ends. A first ribbed end of the plug 44 can be inserted into one end of the auxiliary rail 22. A second ribbed end of the plug 44 can be inserted into one end of the short hollow pipe 30.

Each retaining component 32, as shown in FIGS. 1 through 6, is at least one padded VELCRO strap 46, which will maintain a bottom end of one bracket 28 to one baluster 16. Each retaining component 32, as shown in FIGS. 7 through 10, can also be an adjustable clamp member 48, which will maintain a bottom end of one bracket 28 to one baluster 16.

The adjustable clamp member 48 includes two flexible semi-cylindrical segments 50, 52. A hinge 54 is along abutting rear edges of the semi-cylindrical segments 50, 52. An adjustment screw assembly 56 is between overlapping front edges of the semi-cylindrical segments 50, 52. When the adjustment screw assembly 56 is tightened, the semi-cylindrical segments 50, 52 will clamp onto the baluster 16. The adjustment screw assembly 56 contains a wing head adjustment screw 58, so as to be turned by hand to tighten and loosen the adjustable clamp member 48.

Figure 8:
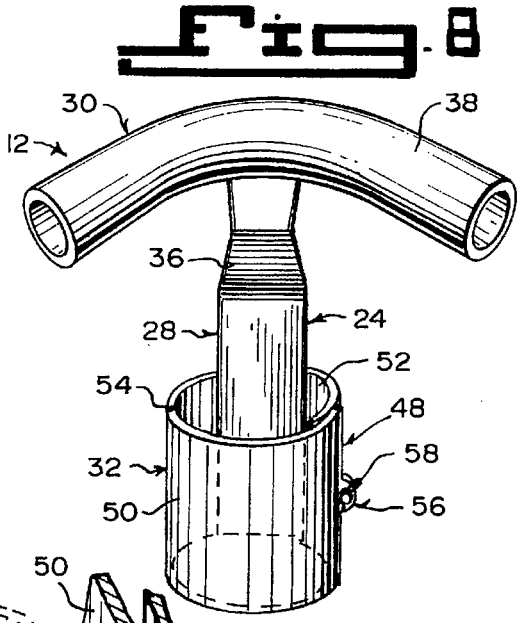
FIG. 8 is a perspective view of the corner bracket of the second embodiment.
Figure 9:
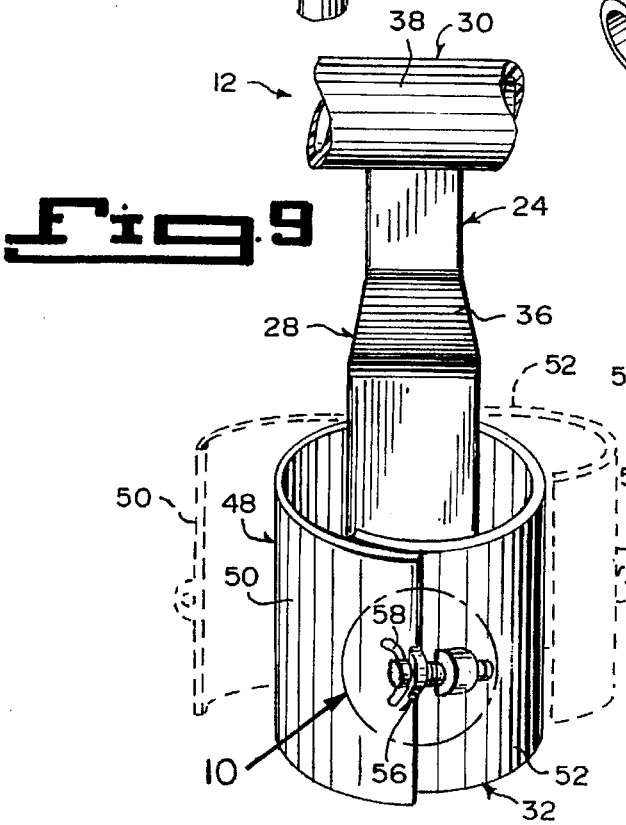
FIG. 9 is an enlarged perspective view taken in the direction of arrow 9 in FIG. 7, with the stairway railing removed and parts broken away.
Figure 10:
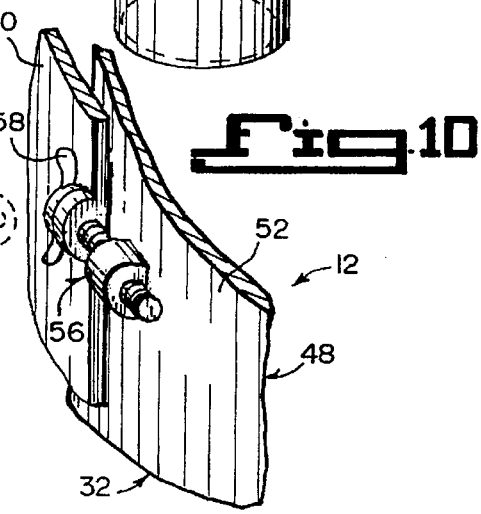
FIG. 10 is a further enlarged perspective view as indicated by arrow 10 in FIG. 9, showing the adjustment screw in greater detail.

The short hollow pipe 30, as shown in FIGS. 1, 2, 4 through 7 and 9 is straight, so as to be used along a straight run of the auxiliary rail 22. The short hollow pipe 30, as shown in FIGS. 1, 3 and 8 is bent, so as to be used at a corner of the auxiliary rail 22.

Figure 11:
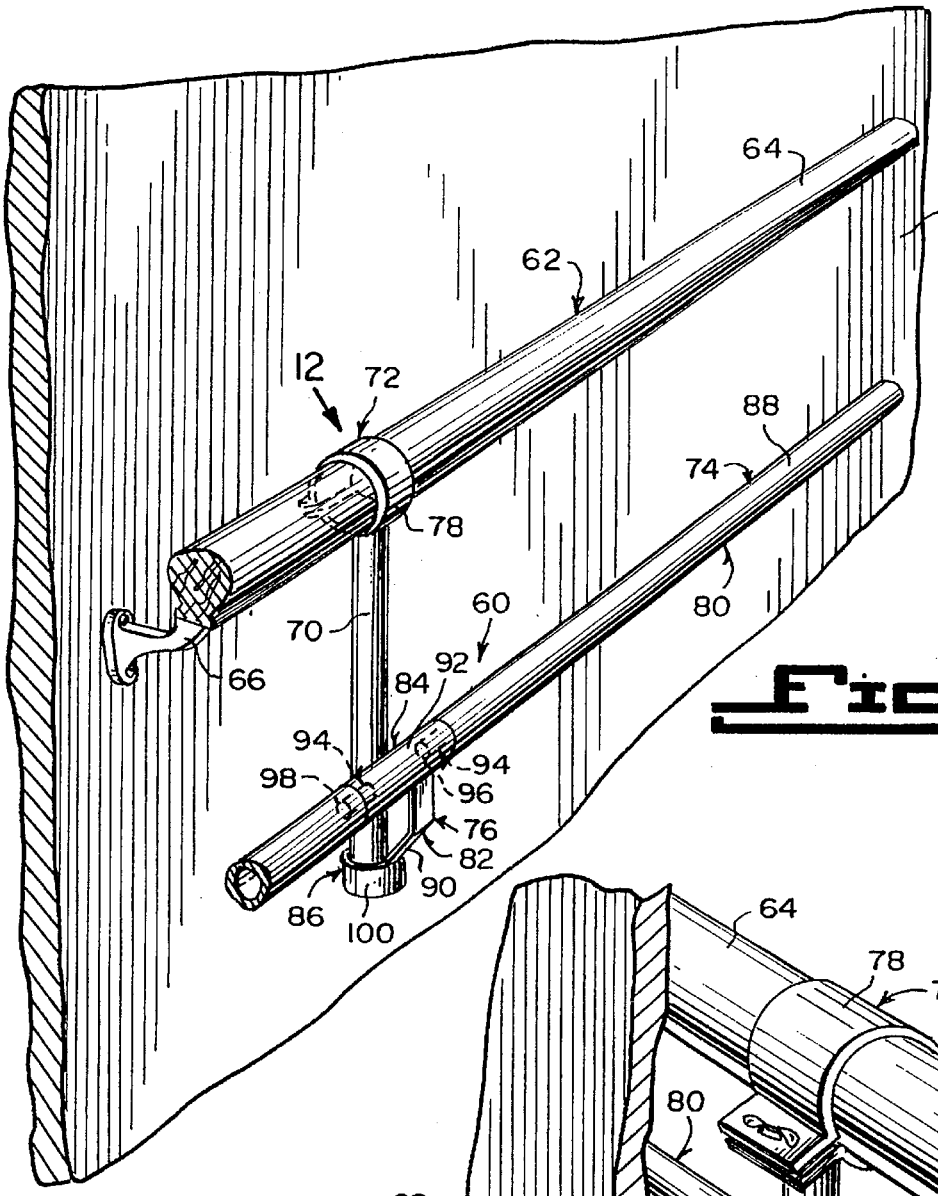
FIG. 11 is a perspective view of a portion of a handrail mounted by a wall bracket into a stairway wall, showing a segment of a third embodiment of the instant invention having a fake baluster connected to the handrail
Figure 12:
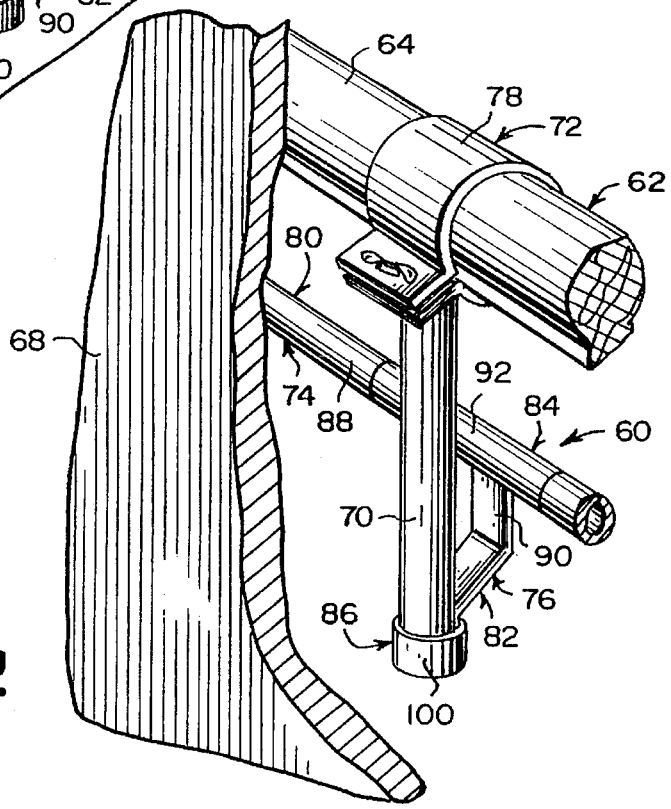
FIG. 12 is an enlarged perspective view taken in the direction of arrow 12 in FIG. 11, with parts broken away.

FIGS. 11 and 12 shows an adjustable stair railing 60 for a stairway railing 62 being a handrail 64 mounted by a plurality of wall brackets 66 onto a stairway wall 68. The adjustable stair railing 60 comprises a plurality of fake balusters 70 an element 72 is for affixing each of the fake balusters 70 to the handrail 64, so that the fake balusters 70 will be spaced apart and hang down from the handrail 64. An auxiliary rail 74 is provided. A facility 76 is for attaching the auxiliary rail 74 to the fake balusters 70 in a height adjustable manner and a parallel relationship below the handrail 64. A young child unable to reach the handrail 64 can now grip the auxiliary rail 74 to travel up and down the stairway in safety, without tripping on the stairway.

The affixing element 72 is a holding device 78 on a top end of one fake baluster 70 that engages with the handrail 64. The auxiliary rail 74 includes a plurality of elongated members 80 that are interconnected to the attaching facility 76.

The facility 76 includes a plurality of brackets 82. Structures 84 are for connecting the brackets 82 to the auxiliary rail 74. Components 86 are for retaining the brackets 82 in a removable manner to the fake balusters 70.

Each elongated member 80 is a hollow tubular bar 88. Each bracket 82 is a flat bent up and out arm 90. Each connecting structure 84 consists of a short hollow pipe 92 transversely mounted on a top end of the bracket 82. An element 94 is for holding one end of the auxiliary rail 74 to one end of the short hollow pipe 92.

The holding element 94, as shown in dotted lines in FIG. 11, is a ribbed stud 96 extending from one end of the auxiliary rail 74 that can be inserted into one end of the short hollow pipe 92. The holding element 94, as shown in dotted lines in FIG. 11, can also be a cylindrical plug 98 being ribbed on both ends. A first ribbed end of the plug 98 can be inserted into one end of the auxiliary rail 74. A second ribbed end of the plug 98 can be inserted into one end of the short hollow pipe 92. Each retaining component 86 is a clamp member 100 which will maintain a bottom end of one bracket 82 to the fake baluster 70.

LIST OF REFERENCE NUMBERS

| | |
|---|---|
| 12 | adjustable stair railing |
| 14 | stairway railing |
| 16 | baluster of 14 |
| 18 | handrail of 14 |
| 20 | stairway |
| 22 | auxiliary rail of 12 |
| 24 | attaching facility of 12 |
| 26 | elongated member of 22 |
| 28 | bracket of 24 |

-continued

LIST OF REFERENCE NUMBERS

| | |
|---|---|
| 30 | connecting structure of 24 |
| 32 | retaining component of 24 |
| 34 | hollow tubular bar for 26 |
| 36 | flat bent up and out arm for 28 |
| 38 | short hollow pipe of 30 |
| 40 | holding element of 30 |
| 42 | ribbed stud of 40 |
| 44 | ribbed cylindrical plug of 40 |
| 46 | padded VELCRO strap for 32 |
| 48 | adjustable clamp member for 32 |
| 50 | first flexible semi-cylindrical segment of 48 |
| 52 | second flexible semi-cylindrical segment of 48 |
| 54 | hinge between 50, 52 |
| 56 | adjustment screw assembly between 50, 52 |
| 58 | wing head adjustment screw of 56 |
| 60 | adjustable stair railing |
| 62 | stairway railing |
| 64 | handrail of 62 |
| 66 | wall bracket of 62 |
| 68 | stairway wall |
| 70 | fake baluster of 60 |
| 72 | affixing element of 60 |
| 74 | auxiliary rail of 60 |
| 76 | attaching facility of 60 |
| 78 | holding device for 72 |
| 80 | elongated member of 74 |
| 82 | bracket of 76 |
| 84 | connecting structure of 76 |
| 86 | retaining component of 76 |
| 88 | hollow tubular bar for 80 |
| 90 | flat bent up and out arm for 82 |
| 92 | short hollow pipe of 84 |
| 94 | holding element of 84 |
| 96 | ribbed stud of 94 |
| 98 | ribbed cylindrical plug of 94 |
| 100 | clamp member for 86 |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An adjustable stair railing for a stairway railing being a handrail mounted by a plurality of wall brackets onto a stairway wall, said adjustable stair railing comprising:

a) a plurality of fake balusters;

b) means for affixing each of said fake balusters to the handrail, so that said fake balusters will be spaced apart and hang down from the handrail;

c) an auxiliary rail; and d) means for attaching said auxiliary rail to said fake balusters in a height adjustable manner and a parallel relationship below the handrail, so that a young child unable to reach the handrail can now grip said auxiliary rail to travel up and down the stairway in safety without tripping on the stairway.

2. An adjustable stair railing as recited in claim 1, wherein said short hollow pipe is straight, so as to be used along a straight run of said auxiliary rail.

3. An adjustable stair railing as recited in claim 1, wherein said short hollow pipe is bent, so as to be used at a corner of said auxiliary rail.

4. An adjustable stair railing as recited in claim 1 wherein said affixing means is a holding device on a top end of one said fake baluster that engages with the handrail.

5. An adjustable stair railing as recited in claim 1, wherein said auxiliary rail includes a plurality of elongated members that are interconnected to said attaching means.

6. An adjustable stair railing as recited in claim 5 wherein each said elongated member is a hollow tubular bar.

7. An adjustable stair railing as recited in claim 1, wherein said attaching means includes:

a) a plurality of brackets;

b) means for connecting said brackets to said auxiliary rail; and c) means for retaining said brackets in a removable manner to said fake balusters.

8. An adjustable stair railing as recited in claim 7, wherein each said bracket is a flat bent up and out arm.

9. An adjustable stair railing as recited in claim 7, wherein each said connecting means includes:

a) a short hollow pipe transversely mounted on a top end of said bracket; and b) means for holding one end of said auxiliary rail to one end of said short hollow pipe.

10. An adjustable stair railing as recited in claim 9, wherein said holding means includes a ribbed stud extending from one end of said auxiliary rail that can be inserted into one end of said short hollow pipe.

11. An adjustable stair railing as recited in claim 9, wherein said holding means includes a cylindrical plug being ribbed on both ends, so that a first ribbed end of said plug can be inserted into one end of said auxiliary rail and a second ribbed end of said plug can be inserted into one end of said short hollow pipe.

12. An adjustable stair railing as recited in claim 7, wherein each said retaining means is a clamp member which will maintain a bottom end of one said bracket to said fake baluster.

13. An adjustable stair railing for a stairway railing being a handrail mounted by a plurality of wall brackets onto a stairway wall, said adjustable stair railing comprising:

a) a plurality of fake balusters;

b) means for affixing each of said fake balusters to the handrail, so that said fake balusters will be spaced apart and hang down from the handrail, said affixing means is a holding device on a top end of one said fake baluster that engages with the handrail;

c) an auxiliary rail that includes a plurality of elongated members that are interconnected to said attaching means; and d) means for attaching said auxiliary rail to said fake balusters in a height adjustable manner and a parallel relationship below the handrail, so that a young child unable to reach the handrail can now grip said auxiliary rail to travel up and down the stairway in safety without tripping on the stairway.

14. An adjustable stair railing as recited in claim 13, wherein said attaching means includes:

a) a plurality of brackets;

b) means for connecting said brackets to said auxiliary rail; and c) means for retaining said brackets in a removable manner to said fake balusters.

15. An adjustable stair railing as recited in claim 14, wherein each said elongated member is a hollow tubular bar.

16. An adjustable stair railing as recited in claim 15, wherein each said bracket is a flat bent up and out arm.

17. An adjustable stair railing as recited in claim 16, wherein each said connecting means includes:

a) a short hollow pipe transversely mounted on a top end of said bracket; and b) means for holding one end of said auxiliary rail to one end of said short hollow pipe.

18. An adjustable stair railing as recited in claim 17, wherein said holding means includes a ribbed stud extending from one end of sail auxiliary rail that can be inserted into one end of said short hollow pipe.

19. An adjustable stair railing as recited in claim 17, wherein said holding means includes a cylindrical plug being ribbed on both ends, so that a first ribbed end of said plug can be inserted into one end of said auxiliary rail and a second ribbed end of said plug can be inserted into one end of said short hollow pipe.

20. An adjustable stair railing as recited in claim 17, wherein each said retaining means is a clamp member which will maintain a bottom end of one said bracket to said fake baluster.

* * * * *